United States Patent [19]

Tidemalm et al.

[11] 4,178,831

[45] Dec. 18, 1979

[54] FLUID PRESSURE DEVICE FOR SUPPORTING AND ELEVATING A GUN BARREL

[75] Inventors: Gustav H. Tidemalm; Björn E. Vidinghoff, both of Karlskoga, Sweden

[73] Assignee: AB Bofors, Bofors, Sweden

[21] Appl. No.: 810,465

[22] Filed: Jun. 27, 1977

[30] Foreign Application Priority Data

Jul. 5, 1976 [SE] Sweden ..... 7607651

[51] Int. Cl.[2] ..... F41F 21/08

[52] U.S. Cl. ..... 89/41 H

[58] Field of Search ..... 89/41 H

[56] References Cited

U.S. PATENT DOCUMENTS

| | | | |
|---|---|---|---|
| 2,381,162 | 8/1945 | Taylor | 89/41 H |
| 2,946,262 | 7/1960 | Bruehl | 89/41 H |
| 3,952,632 | 4/1976 | Eriksson et al. | 89/41 H |

*Primary Examiner*—Stephen C. Bentley

*Attorney, Agent, or Firm*—Pollock, Vande Sande & Priddy

[57] ABSTRACT

Apparatus for supporting and elevating a gun barrel, wherein a pair of telescoping cyclinders are attached to the barrel and frame of the gun, respectively. A piston assembly positioned between the cylinders supports the unbalanced weight of the barrel against a fluid medium with a control valve varying the resulting pressure ratio during elevation of the barrel.

18 Claims, 8 Drawing Figures

C–C

FLUID PRESSURE DEVICE FOR SUPPORTING AND ELEVATING A GUN BARREL

BACKGROUND OF THE INVENTION

The present inventon relates to an elevating cylinder device for use in positioning a barrel of a gun, particularly of a large calibre, for instance the 155 mm calibre. The elevating cylinder comprises two telescopically arranged parts, of which the first part is secured in a mounting or the like and the second part is connected with the gun barrel. Regarding the telescopic parts, the first telescopic part is made in the form of a piston unit, to the upper and under sides of which an operating medium, for instance hydraulic fluid, can be connected via first and second connection channels.

It is considered desirable for field-artillery weapons which utilize elevating cylinders to be able to make an installation which is simplified to the greatest possible extent, especially regarding the piping for transporting the operating medium between the cylinders and a source of power utilized on the gun, such as a hydraulic unit.

OBJECTS AND SUMMARY OF THE PRESENT INVENTION

The present invention is primarily concerned with these problems, and the present invention makes it possible to utilize only one medium supply pipe to the respective cylinder for the elevation and depression functions, which substantially simplifies the practical installation of piping on the gun.

A further object of the present invention is to construct an elevating cylinder of technically simple and economically advantageous components which provide efficient damping properties against upward jump or recoil movements which take place in the barrel during the firing operation. Good damping properties can then be obtained both when firing with open and with closed blocking valves. The new device is also constructed in such a way that it is possible to eliminate stresses due to temperature variations, which are known to influence the equipment when the barrel is in its clamped position.

Another object of the present invention is to provide for simple handling of the elevating and traversing functions of a gun of said kind. It is noted that the barrel can be run at the full elevating velocity towards the maximum angle of elevation, where effective, built-in damping, efficiently and gently brakes the upward movement of the barrel.

A distinguishing feature of a device formed according to the present invention is that in one of the connection channels comprising the first and second connection channels a pressure distribution valve is linked to achieve a predetermined relation between the pressure of the medium at the upper and under sides of the piston unit.

BRIEF DESCRIPTION OF THE DRAWINGS

A preferred embodiment of the present invention will be described in the following, with reference to the accompanying drawings, in which.

DETAILED DESCRIPTION OF THE PREFERRED EMBODIMENT

Figure 1:
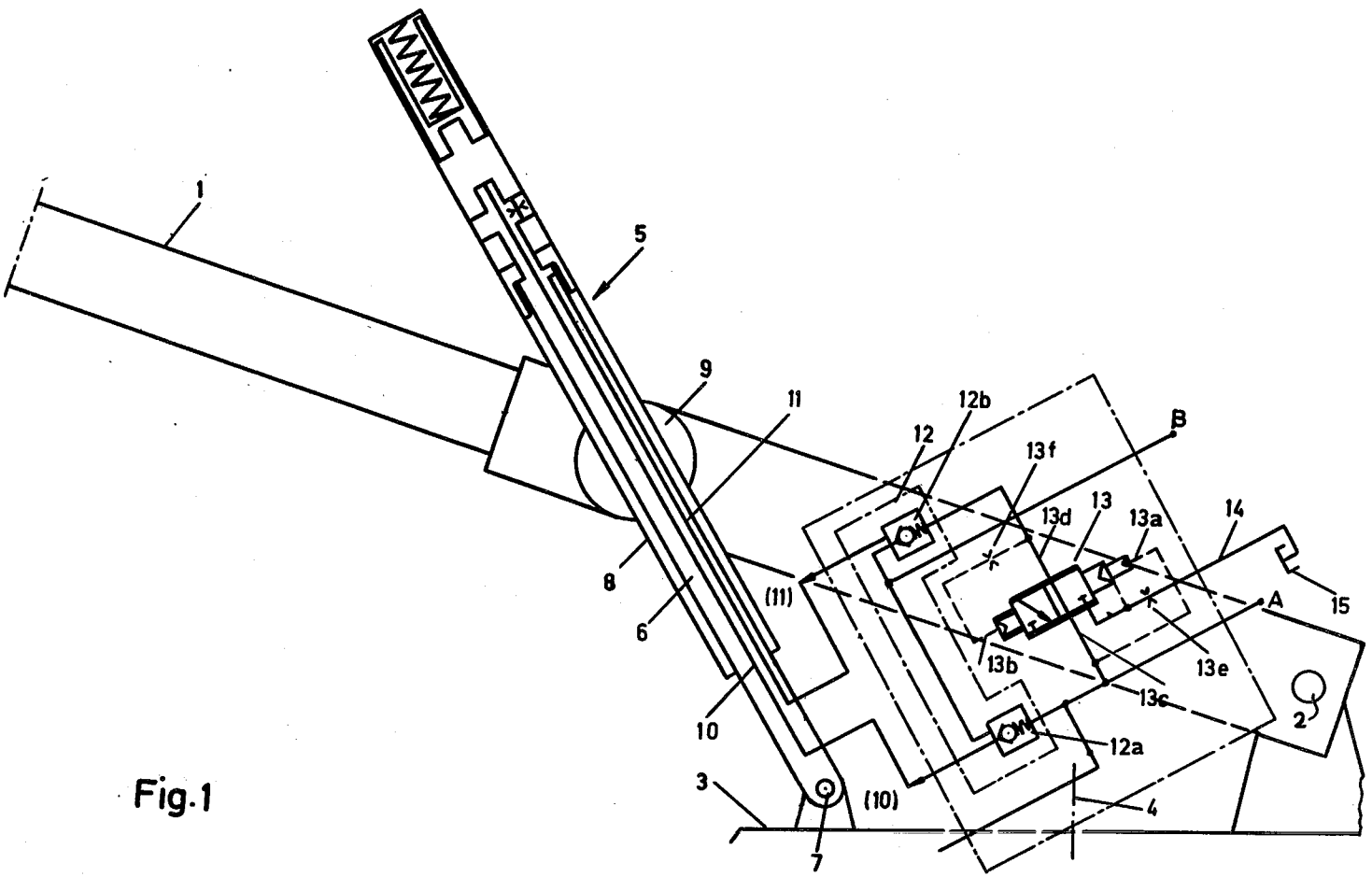
FIG. 1 shows a view from the side and partly in diagrammatic form of an elevating cylinder formed according to the invention.

In FIG. 1, the numeral 1 designates a barrel which is elevatably supported at one end on a conventional trunnion 2. The supporting device for the barrel is arranged on an upper mounting 3 which, in turn, is transversely rotatable around a centre axis 4. The barrel 1 and upper mounting 3 are arranged on an artillery weapon, for instance a field artillery weapon, which can be of a conventional type. The barrel can have a calibre of, for example, 155 mm.

To perform the elevating function, the barrel is provided with two elevating cylinders 5, one on each side, of which only one is shown in FIG. 1. Each elevating cylinder is made with two telescopically arranged parts, of which the first telescopic part 6 has a free end rotatably secured to the upper mounting 3 in a similar way as the barrel. The telescopic first part 6 is supported on a futher supporting journal 7, so that the part 6 can be tilted in the plane of the paper in FIG. 1, while at the same time following the traversing movements of the upper mounting 3. The second telescopic part 8 is supported in a spherical support 9 of barrel 1, with the support shown in FIG. 1 being positioned at a central section of the centre part.

The displacement of the first and second telescopic parts 6 and 8 in relation to each other in the respective elevating cylinder 5 takes place with the aid of hydraulic fluid, which has the result that, in principle, the barrel will rest upon a column of hydrualic fluid in the elevating cylinder. The suspension shown for the barrel involves that there is an unbalance in the barrel for the elevation movements, i.e. the actuating force for the elevation is dependent on the angle of elevation.

The inner, or first telescopic part 6 is provided with a piston unit which will be described in more detail in the following, and the elevating cylinder 5 is moreover provided with first and second connection channels 10 and 11 for hydraulic fluid (or a corresponding medium).

At the connection with channels 10 and 11, a blocking valve 12 is arranged, with blocking valve elements **12*a* and 12*b* for the first and second connection channels, respectively, and also including a pressure distribution valve 13, consisting of a three-way hydraulic pressure control valve. The first connection channel 10 is connected via the first blocking valve element 12*a* to a source of operating pressure provided at point A. The second connection channel 11 is conencted to the second blocking valve element 12*b* and the pressure distribution valve 13, which has two control inlets 13*a* and 13*b* and two connections 13*c* and 13*d* for the passage of a medium. The control inlet 13*a* is then connected to the operating pressure via the connection A, and the control inlet 13b is connected via the second blocking valve element 12b and a constriction 13f so that it senses the pressure on the under side of the piston unit. The connection 13c on the pressure distribution valve is connected in parallel with the first blocking valve element 12a** to the operating pressure provided at point A.

At a drain pipe 14 the pressure distribution valve is provided with a further constriction 13e. The purpose of the pressure distribution valve is to ensure that there is a predetermined relationship between the hydraulic fluid pressure on the upper and under sides of the piston units, and it is therefore arranged so that, depending on the operating pressure and the existing pressure on the under side of the piston unit, it will connect the second connection channel either to the operating pressure or to a tank 15 via the drain pipe 14. The blocking valve 12 is connected to an operating pipe via point B so that it is possible to connect or disconnect a pressure to the blocking valve for opening or closing of the blocking valve elements 12a and 12b. The blocking valve elements are intended to be opened to elevate or depress the barrel closed to provide fixed elevation or depression positions for the barrel 1, and also when the barrel is in the clamped position. The arrangement shown with blocking and distribution valves permits firing with open blocking valves, which is essential for efficient target tracking.

Figure 2:
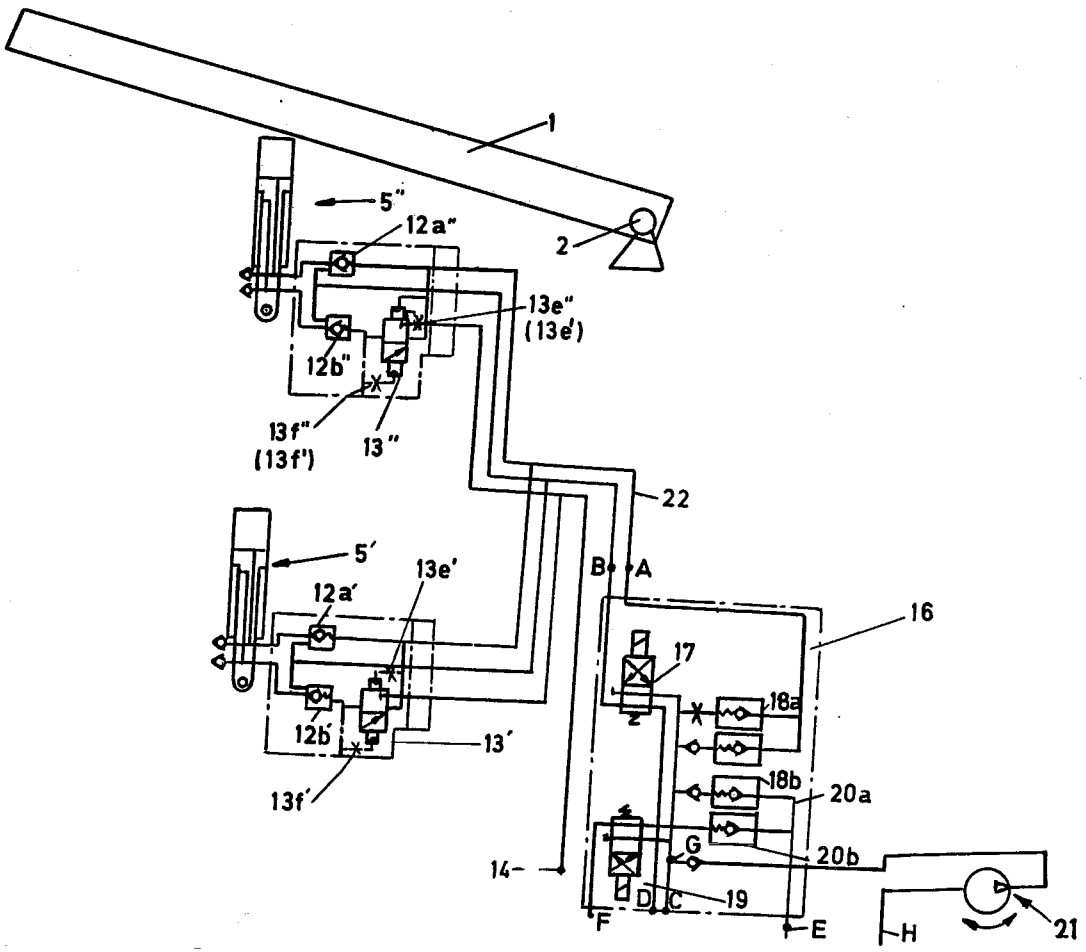
FIG. 2 shows a diagram of the components comprising a field-artillery weapon formed according to the present invention.

FIG. 2 is intended to show the complete operating equipment for the two elevating cylinders 5' and 5'' necessary for elevation of the barrel 1, which are provided with identical equipment as regards the blocking valve elements 12a', 12b' and 12a'' and 12b'', respectively and the pressure distribution valve 13' and 13'' respectively, with the constrictions 13e' and 13e'' and 13f' and 13f''. An operating unit 16 is also included, which is common for both the elevating and traversing functions of the gun in question. The operating unit 16 comprises a first operating valve 17 and a first control valve 18a, 18b for the elevating control. The traversing control system comprises a second operating valve 19 and a second control valve 20a, 20b. In FIG. 2, the connection points A and B positioned according to FIG. 1 are also indicated. There is also a point C indicated, which is connected to the system pressure in a hydraulic system, not shown in detail, for the field-artillery weapon in question. The connection point C, like the drain pipe 14, is connected to a tank, not shown, in the hydraulic system. The draining to the tank takes place via filters and, possibly, coolers in the system. The connection points E and F are connected to directing members, not shown, in the traversing equipment. A hand pump 21 is also indicated, by means of which the elevating and traversing can be carried out manually if the pressure in the system should be lost. Said hand pump is connected to the system pressure pipe at a point G, and to said tank via a point H.

During elevation and depression, in accordance with the above, the blocking valves 12a', 12b' and 12a'', 12b'', respectively, are open. Opening takes place through actuation of the operating valve 17 from the position shown in FIG. 2. During actuation, the system pressure is connected to the operating pipe of the blocking valve. Elevation or depression then takes place by means of a control lever on the control valve 18a, 18b with the operating pressure obtained from the control valve being allowed to act directly on the upper side of said piston unit. The pressure distribution valve 13', 13'' achieves that the relation between the pressure of the medium on the upper and under sides of the piston unit are, for instance, 1:8 during depression and a stationary barrel. At elevation of the barrel, however, the pressure relation is varied on the upper and under sides of the piston unit with the aid of the constriction 13e', 13e''. The variation is dependent on the elevating velocity. The greater the velocity, the more the pressure relation will approach 1:1. At the sudden jumping movements upwards which occur in the barrel when firing when the blocking valve elements are open, the pressure distribution valve 13 disengages the pressure distribution function by closing the drain pipe 14. Due to the unbalance in the suspension of the barrel, the speed of said jumping movement upwards is dependent on the angle of elevation at which the firing takes place. The higher the angle of elevation the greater the speed of the jumping movement upwards of the barrel. The function of the pressure distribution valve can then be chosen so that closing of the drain pipe 14 does not take place when firing at low angles of elevation, but the pressure relation assumes values closer to 1:1. The pressure distribution valve also ensures that there will never be an under-pressure on the under side of the piston unit, and thereby prevents air relese from the fluid.

The arrangement shown with pressure distribution and control valves also involves that the hydraulic fluid can be conducted to and from the upper side of the piston unit via one and the same pipe 22. Elevation takes place by filling in hydraulic fluid and depression by draining off hydraulic fluid via said pipe 22. Filling and draining takes place by means of the control valve 18a, 18b, with which also the aiming velocity is determined. The function of the control valve will be described in more detail in the following. Blocking of the blocking valves takes place by moving the operating valve back to the position shown in FIG. 2.

Traversing takes place in the corresponding way as elevating, but with the difference that the system pressure gives a counter-pressure on a so-called small area on the traversing cylinder.

Figure 3A:
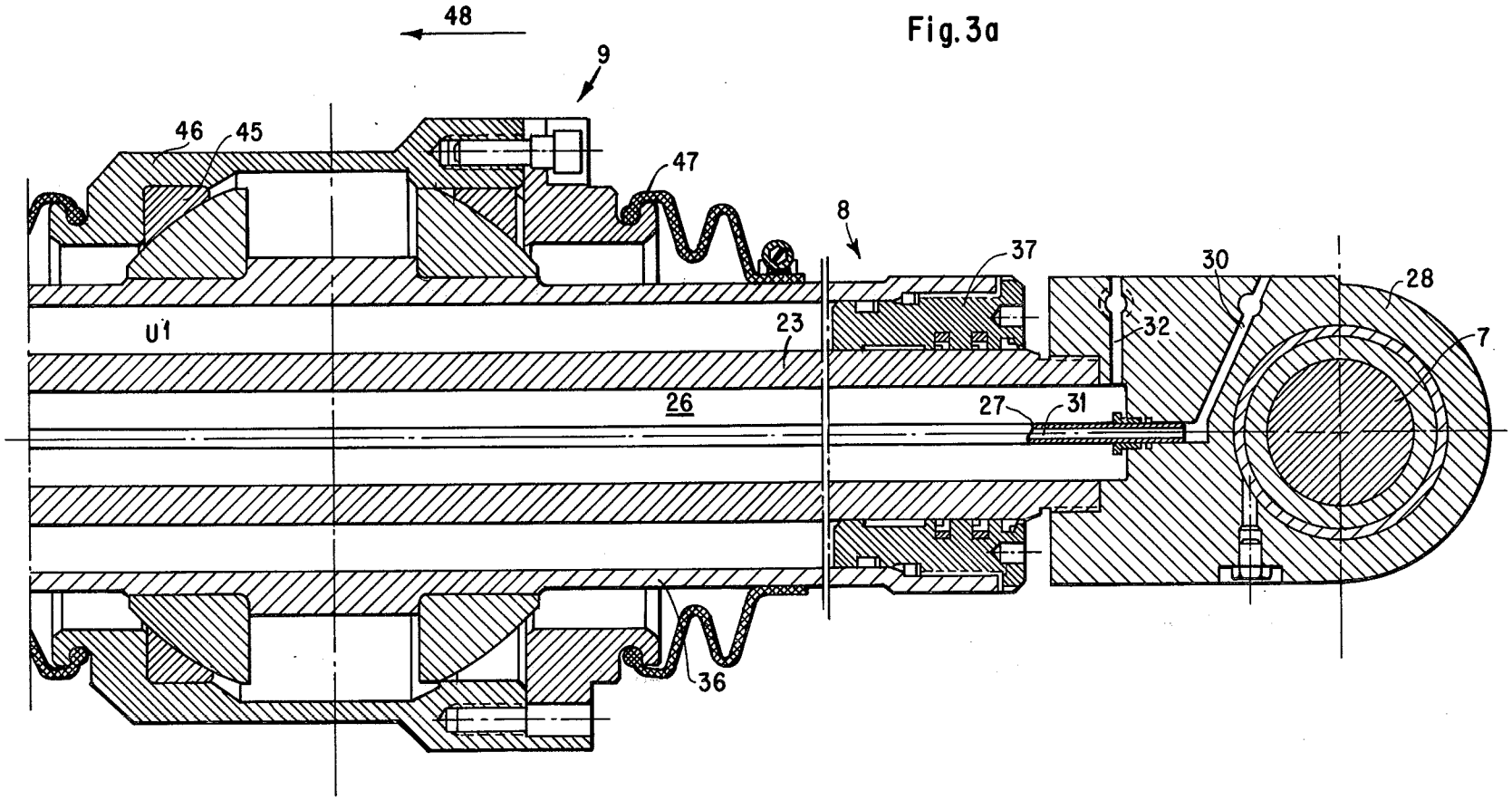
FIGS. 3*a*–3*b* each show a longitudinal section of a hydraulic cylinder adaptable for use with the device formed according to FIG. 1 (FIGS. 3*a* and 3*b* should appropriately be placed together when viewing them)
Figure 3B:
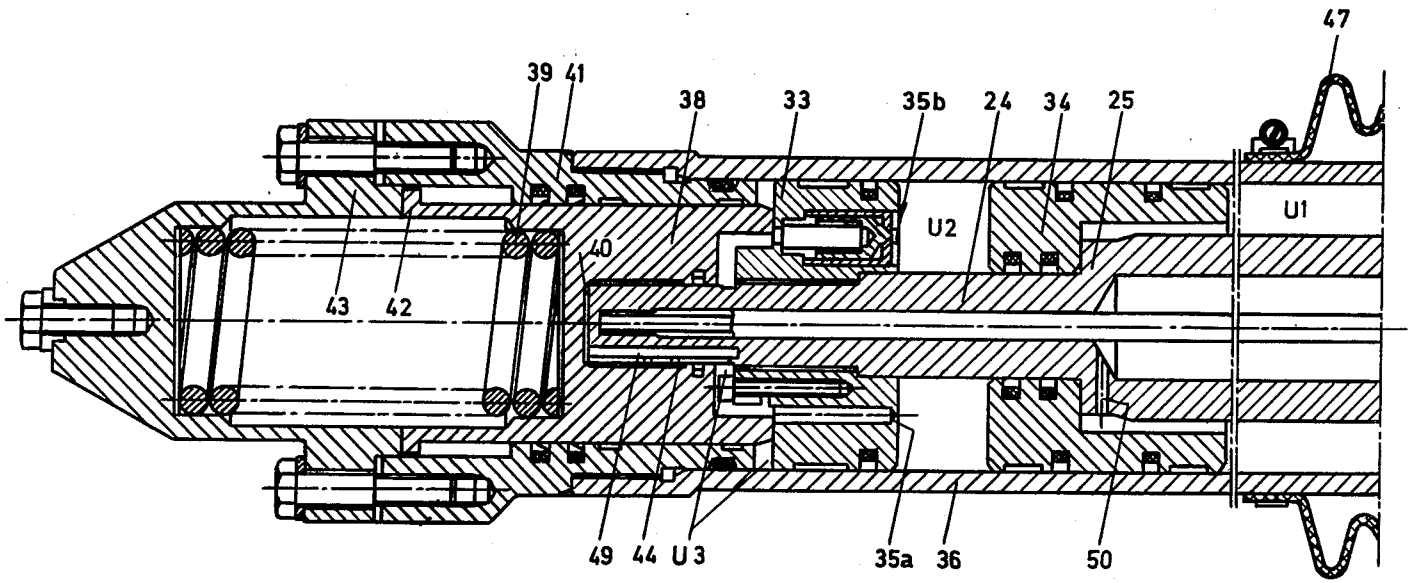

As shown in FIGS. 3a and 3b, which should appropriately be viewed with their ends placed together, the first telescopic part comprises a pipe 23, at the top of which there is a tapered section 24, which starts with a pronounced shoulder 25. The pipe has a through hole, which extends through the center of the pipe in the longitudinal direction thereof. The first section 26 of the hole has a larger diameter than the second section which, in principle, extends into the tapered section 24. Pressed into the second section of the hole in the pipe 23 is an inner pipe 27, which extends through the center in the first section 26 of the hole in the pipe 23. At its lower end, the pipe 23 is secured in a supporting part 28, which is also included in the first telescopic part. Also the inner pipe 27 is inserted and sealed in the supporting part 28, which is rotatably supported on the journal 7. Arranged so that it can be fastened on the supporting part is a unit 29, shown in FIG. 5a–5c, which integrated supports the blocking valve 12a, 12b and the pressure distribution valve 13 for the elevating cylinder in question. The supporting part 28 is made in the form of a first connection hole 30 which connects the first blocking valve element 12a with the through hole 31 of the inner pipe 27 and a second connection hole 32 which connects the second blocking valve element 12b with the hole section 26 in the pipe 23.

At its other end, at about the central parts of the tapered section 24, a fixed piston part 33 is fastened, which together with a so-called floating piston part 34 is included in the above-mentioned piston unit which is allotted to the first telescopic part. The floating piston part 34 is arranged so that it can be displaced in relation to the pipe 23, between end positions which are defined by the fixed piston part 33 and the shoulder 25. Fastening of the pipe 23 in the supporting part 28, and positioning the first piston on the pipe 23 can be achieved in various ways, and in the case shown it has been done by means of threads and a nut. The fixed piston part is moreover provided with at least one constriction 35*a*, via which hydraulic fluid can pass from the upper side of the floating piston to the upper side of the fixed piston, or vice versa. The fixed piston is also provided with what is here called a shock valve 35*b*, which in order to smoothen out damping characteristics achieved by the piston unit is arranged to open the passage between the upper side of the floating piston and the upper side of the fixed piston when the pressure at the first-mentioned side exceeds the value at the last-mentioned side by a predetermined value. The shock valve comprises a spring-loaded slide, which seals against a seat in the normal case, and which is pressed away in order to permit the passage of medium in the case when the pressure on the upper side of the floating piston exceeds the pressure at the upper side of the fixed piston by the predetermined value.

Also the second telescopic part (8 in FIG. 1) comprises a pipe, which is here called the outer pipe 36, which is supported on the pipe 23 via said pistons 33 and 34, and a cylinder end 37 allotted to it and arranged at its lower end. At the upper parts of the outer pipe 36, space is provided for a compensation piston 38, which is kept pressed in the direction towards the fluid space U3 by a strong spring 39. Normally, the piston 38 is kept pressed against an end part 43 by the hydraulic pressure. The compensation piston has a recess 40, against which the compensation piston can close around the free end of the tapered section 24 when the barrel is in the depressed position (position according to FIGS. 3*a*, 3*b*) or a substantially depressed position. The compensation piston is supported in a sleeve 41, which can be screwed to the inner wall of the outer pipe at the free ends of the outer pipe. The compensation piston is then made in the form of an outwardly directed flange 42, which through coaction with a shoulder on the sleeve 41 defines one longitudinal displacement position of the compensation piston. The other longitudinal displacement position of the compensation piston is defined through the coaction of the flange 42 with an end surface of the end part 43 which is fastened in the sleeve. In the depressed position, the compensation piston 38 will be in mechanical contact with the fixed piston 33.

At its free end, the tapered section 24 is provided with a number of holes 44 located along the longitudinal direction of the section in a way which is known in itself, which through coaction with a wall section in the recess 40 in the compensation piston are included in a so-called end position damping device.

On the outer pipe 36, there is also arranged a support comprising a spherical bearing 45, contained in a bearing housing 46. A dust protecting device 47 is also applied at the bearing, to prevent dirt from entering into the support 9.

The components described above are sealed in relation to each other with seals of various kinds, and which can be of designs which are known in themselves. The sleeve 41 can be secured to the outer pipe 36 by means of threads or the like. FIGS. 3*a* and 3*b* show the completely telescoped position of the telescopic first and second parts of the elevating cylinder. At elevation, the outer pipe is actuated in the direction shown by the arrow 48.

At said piston unit with the fixed piston 33 and the floating piston 34, under the floating piston, a space U1 is formed. Between the fixed and the floating piston, a variable space U2 is obtained, and the maximum volume of the variable space is shown in FIGS. 3*a* and 3*b*. In principle, the minimum volume can be nothing at all, which would occur if the floating piston should come into contact with the under side of the fixed piston, but which last-mentioned case, however, it is here assumed will not occur. A third space U3 is formed on the upper side of the fixed piston.

The space U3 is connected with the operating pressure obtained from the control valve via inter alia the open blocking valve element 12*a*, the connection hole 20 and the through hole 31 in the inner pipe 27. In the depressed position of the barrel, the passage will also comprise a remaining slot between the bottom surface of the recess 40 of the compensation piston and the end surface of the tapered section 24, an eccentric hole 49 extending from the end surface of the tapered section and into the material of the tapered section in the longitudinal direction of the section, and one or several of said holes 44 for the end position damping device, which extends from the eccentric hole 49 through the material and out to the envelope surface of the tapered section. On the other hand, when the tapered section 24 is away from the recess 40, the medium in question obtains direct contact with the upper side of the first piston and via said constriction 35 with the upper side of the floating piston. The compensation piston is thus included in the end position damping device.

The space U1 is in contact with the distribution valve via the opened control valve element 12*b*, the hole connection 32 and the hole section 26 in the pipe 23 and a passage 50 at the inner end of the hole section 26.

Due to the unbalance in the suspension of the barrel, the pressure level of the medium present in the spaces U2 and U3 will vary in dependence on the angle of elevation of the barrel, with the pressure being approx. 25 bar at the maximum angle of elevation, and approx. 50 bar at an angle of 0°, if the medium column on which the barrel rests carries approx. 4.5 tons. On the under side of the floating piston, the pressure is kept by the pressure distribution valve at a value which for a stationary barrel and depression of the barrel is approx. $\frac{1}{8}$ of the pressure on the upper side and for elevation movements of the barrel between $\frac{1}{8}$ and 1/1 of the pressure on the upper side. When firing with open blocking valves, the pressure distribution function is closed entirely, possibly except at the lowest angles of elevation.

The arrangement with inter alia the fixed and the floating piston gives good damping properties for jumping movements upwards of the barrel in connection with firing with closed blocking valves. When a round is fired, the barrel is lifted upwards and the enclosed hydraulic fluid in the space U1 presses the floating piston upwards. The hydraulic fluid in the space U2 is pressed through the constriction 35 to the space U3, whereby a damping force directed against the direction of movement is obtained. The shock valve 35*b* sometimes enters into function also, and then limits the damping force to a certain desired adjustable level. When the kinetic energy has been consumed, the barrel falls back, and damping takes place in the opposite direction, until the floating piston has resumed its original position against the shoulder 25 in the pipe 23. The compensation piston equalizes the change in volume in the space U3, and thereby protects against under-pressure, so that there will be no air release in the fluid. The space U2 can thus be regarded as a damping volume.

When the barrel is in the clamped position, the arrangement shown also prevents stresses from arising due to variations in temperature. When the barrel is to be clamped, it is depressed with open control valves to a support utilized for the barrel. As the column of medium is connected with the drain pipe to the tank via the control valves, the pressure relief will take place with the aid of the compensation piston with the piston pressing out fluid into the tank, which involves that there will be no pressure in the system before the control and blocking valves are closed. The compensation valve is kept pressed out by its spring 39. At an increase in temperature, the remaining fluid expands. The floating piston part 34 and the compensation piston 38 take up the change in volume, and prevent any forces from being transferred from the cylinders to the clamping device, and forces from being transferred from one cylinder to the other. The clamping position is approx. 5° higher than the position shown in FIGS. 3*a* and 3*b*.

When the barrel is in its fully elevated position, the cylinder end 37 is in contact with the floating piston 34 so that in attempting to reach an elevative position beyond the maximum elevation position, it will lift the floating piston 34 from the shoulder 25. This lifting involves that the active area of the lifting force is reduced by the area of the floating piston, and has only a value as the projected area of the diameter of the tapered section which is then chosen in such a way that the barrel cannot be held with said projected area, but the barrel will strive to sink back until the floating piston again rests against its shoulder. In this way, the barrel can be run with the full elevating velocity to the fully elevated position, and an efficient braking down function is obtained, which is built into the arrangement shown.

Figure 4:
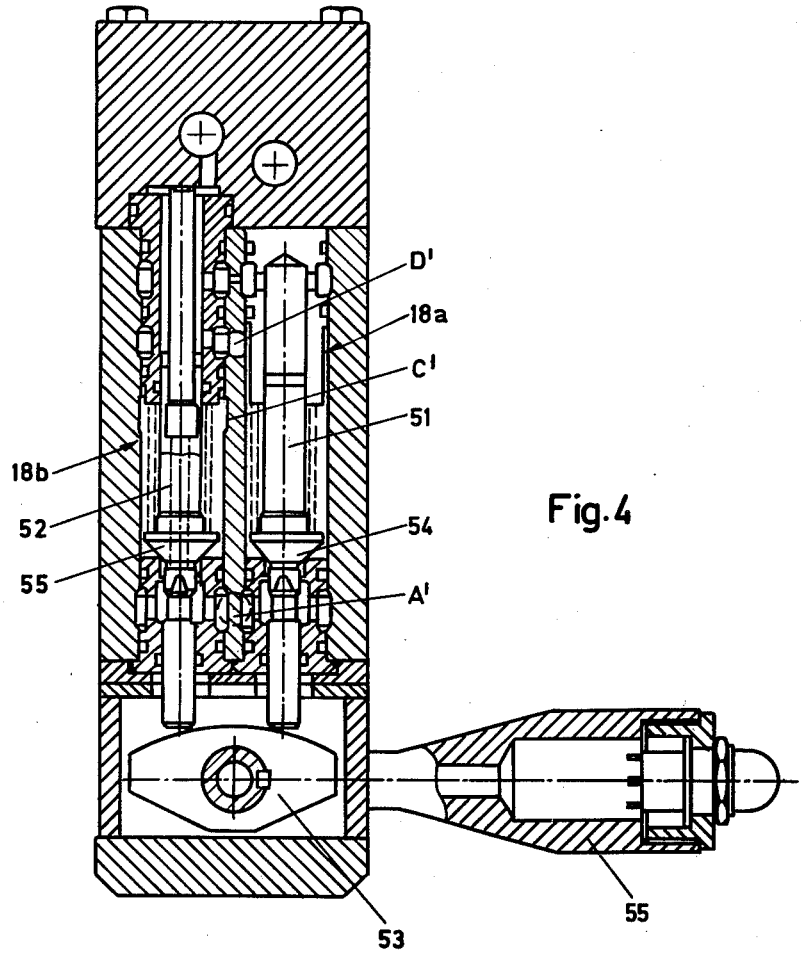
FIG. 4 shows a detailed cross-sectional view of a control valve which is included in the components shown in FIG. 2.

The control valves for the elevation and traversing control are built up identically. As shown in FIG. 4, which is intended to show the control valve for the elevation, the respective control valve comprises two valve spindles 51 and 52 and an eccentric cam 53. Each valve spindle is combined with a seat valve 54 and 55, respectively, and the eccentric curve is arranged so that it can be turned by means of an operating handle 55.

The control valve also has an inlet connection C', for the system pressure, which for instance can assume a value of 110 bar, a connection A' which is connected to the connection point A in e.g. FIG. 2 and an outlet connection D', which is connected to the tank for the hydraulic system.

During actuation (lifting) of the valve spindle 52 and its seat valve 55, a connection is obtained between the connections C' and A' which is dependent on the amount of the actuation. The greater the actuation, the more fluid is fed in over to the connection A' from the connection C', whereby the aiming velocity is determined by means of the control valve. At the actuation of the valve spindle 52 and the seat valve 55, the valve spindle 51 and its seat valve 54 are closed.

At the actuation of the valve spindle 51 and the seat valve 54 by means of the eccentric cam, the connection A' is connected to the connection D', and fluid will then be conducted from A' to D', involving a depression of the barrel. During this actuation of the valve spindle 51 and the seat valve 54 the valve spindle 52 and the seat valve 55 are unactuated. In the neutral position of the eccentric cam all pipes are thus kept closed by the seat valve, so that the barrel cannot drift when there should be no aiming movement of the barrel.

Figure 5A:
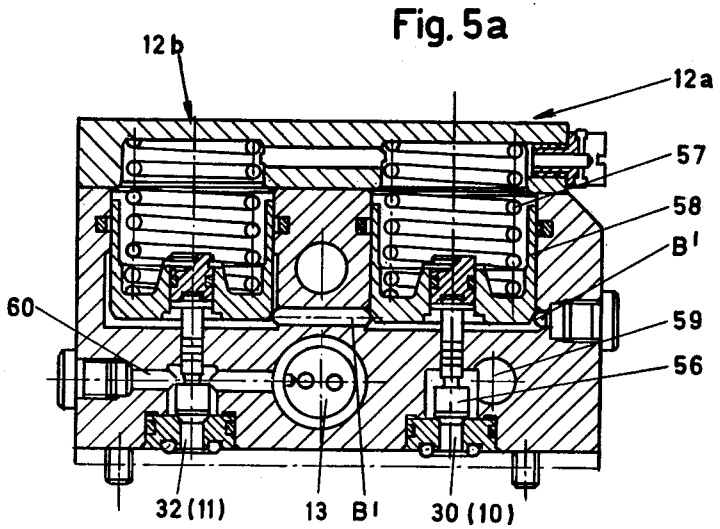
FIGS. 5*a*–5*c* show a unit in various sections which can be applied to the elevating cylinder formed according to FIGS. 3*a* and 3*b* and comprising a blocking valve and pressure distribution valve.

The operating valve 17 (according to FIG. 2) which is included in the operating unit 16 with the control valves can consist of a hydraulic three-way two-position valve of a known type, which is spring-loaded towards one position, and electrically (via an electromagnet) actuated to its other position. The design of the blocking valve will be noted from FIG. 5*a*. The blocking valve elements 12*a*, 12*b*, each comprise a seat valve 56 which is actuated to its closed position by a spring 57. In FIG. 5, the connection for the operation of the blocking valve element is symbolized with B'', via which connection the operating pressure for the blocking valve is conveyed to a piston unit 58 which actuates a seat valve. At the connection of the operating pressure for the blocking valve, the piston unit 58 is pressed against the force of the spring 57, and the actuation of the seat valve towards the closed position ceases, and a connection 50 and 60, respectively is connected to the connection holes 30 and 32, respectively (FIG. 3*a*). When the operating pressure on the unit 58 disappears, the spring 57 will again close the seat valve 56. In FIG. 5*a*, the distribution valve is designated with the numeral 13.

Figure 5B:
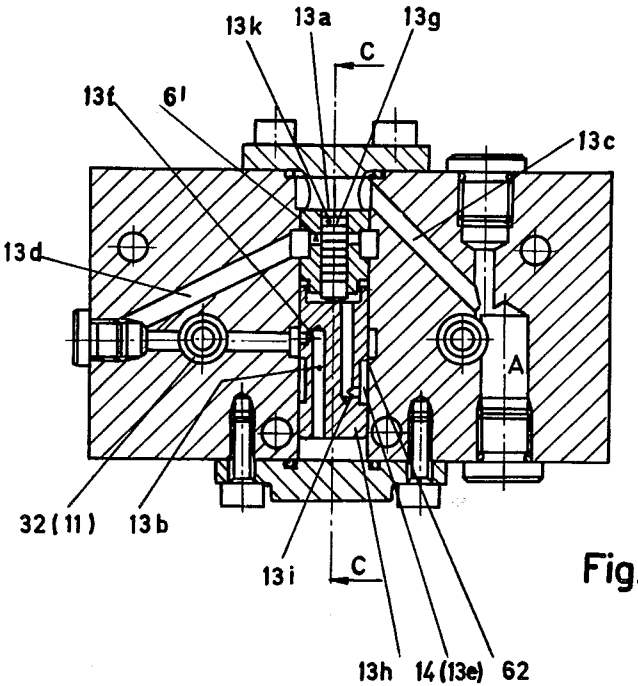

In principle, the distribution valve 13 comprises two slide valves 13*g* and 13*h* which can be displaced longitudinally, as shown in FIG. 5*b*. The slide valves each work against its control edge 61 and 62, respectively. The slide valves are arranged with their ends in contact with each other, the slide valve 13*g* then being arranged in a fixed piston lining supporting the control edge 61 which, in turn, is arranged at one end of a recess in which the slide valve 13*h* is applied so that it can be displaced. The slide valve 13*g* has a piston area which can be ⅛ of the piston area of the slide valve 13*h*.

When stationary and at depression of the barrel, the slide valve 13*g* regulates against the control edge 61 and keeps the pressure on the under side of the piston 34 (FIG. 3*b*) substantially constant, and so that the pressure on the under side is approx. ⅛ of the pressure on the upper side. During depression of the barrel, fluid is fed from the connection A to the connection hole 32 (the connection channel 11) over said control edge 61. At the same time, hydraulic fluid on the upper side of the piston unit 33, 34 is returned to the tank.

Figure 5C:
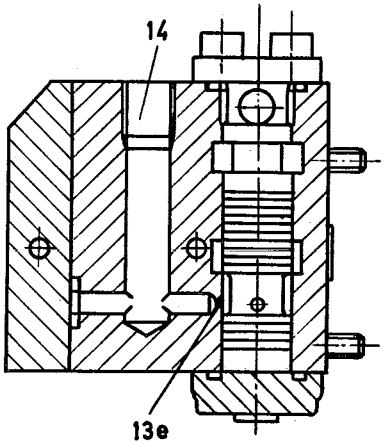

During elevation of the barrel, fluid is fed from the inlet A to the connection hole 30 (=connection channel 10) to the upper side of the piston unit 33, 34, and at the same time fluid is drained from the under side of the piston 34 to the drain pipe 14 (FIG. 5*c*), which takes place via the control edge 62 and the constriction 13*e* (FIG. 5*c*). The constriction 13*e* causes a velocity dependent added force to be obtained via a channel 13*i* on the side of the slide valve 13*h* which coacts with the slide valve 13*g*. The added force strives to close the valve against the drain pipe 14, whereby the pressure relation is changed in dependence on the elevating velocity, and at the highest elevating velocities approaches 1:1.

When firing, jumping movements upwards are obtained in the barrel, which particularly at high angles of elevation will be of a magnitude that involves that said added force assumes values which cause closing of the drain pipe 14. The piston unit 33, 34, can in this way carry out the damping function described above, even if firing takes place with open blocking valves.

The slide valves 13*g* and 13*h* work with long overlapping sections 13*k* and 13*l*, respectively, which prevent an undesirable flow of hydraulic fluid in the closing positions of the valves.

The length of stroke of the telescopic units is of the magnitude of 0.8 m.

The invention is not limited to the embodiment shown above as an example, but can be subject to modifications within the scope of the following claims.

We claim:

1. Apparatus for supporting and elevating the barrel of an artillery weapon and the like, said apparatus comprising:

first and second telescoping cylinder members, one of said cylinder members pivotally attached to a frame portion of said weapon and said remaining cylinder member rotatably attached to said barrel;

a first piston member fixed within said telescoping cylinder members and a second piston member selectively movable within said telescoping cylinder members toward and away from said fixed piston member for supporting said barrel while dampening any sudden movement of said barrel;

passage means extending through said telescoping members into contact with said piston assembly means for selectively providing a first, positive pressure against a first side of said piston assembly means and for providing a second, positive pressure against a second side of said piston assembly means; and pressure distributing valve means joining said passage means for controlling the pressure ratio across said piston assembly means to support and elevate said barrel as required.

2. An apparatus according to claim 1, wherein said first positive pressure force is partially provided by the unbalanced weight of said barrel and said second positive pressure force is provided by a column of hydraulic fluid.

3. An apparatus according to claim 1, wherein said first pressure force acts against said fixed piston member and said second opposed pressure force acts against said movable piston member;

and a variable quantity of pressurized fluid positioned in a substantially cylindrically shaped chamber formed by said fixed piston and movable piston members and said first and second cylinder members opposing movement of said movable cylinder.

4. An apparatus according to claim 3, wherein said fixed piston member includes at least one construction extending longitudinally therethrough, providing a passage for transferring pressurized fluid into and out of said cylindrically-shaped chamber to dampen the movement of said movable piston.

5. An apparatus according to claim 1 wherein said passage means comprises first and second fluid channels extending through said telescoping cylinder members, said pressure distribution valve means being positioned in said channel having an end portion in contact with a side of said movable piston member closest to the point of attachment between said cylinder members and said weapon frame.

6. An apparatus according to claim 1, wherein said pressure distribution valve means achieves a pressure ratio across said piston means of substantially 1:8 to support said barrel at various elevated positions and to lower said barrel relative to said weapon frame.

7. An apparatus according to claim 1, wherein said pressure distribution valve means achieves a pressure ratio across said piston means which is at least 1:8 and no greater than 1:1 to allow elevation of said barrel relative to said weapon frame wherein the particular pressure ratio is directly dependent on the velocity of the barrel during elevation.

8. An apparatus according to claim 5, wherein blocking valve means are positioned in said passage means, said blocking valve means being selectively actuable to an open position to disengage said pressure distribution valve means responsive to sudden upward movement of said barrel.

9. An apparatus according to claim 8, wherein said pressure distribution valve means is connected in parallel to a first fluid passageway extending from a source of fluid pressure through said blocking valve means and joins one of said fluid channels extending through said telescoping cylinders;

said pressure distribution valve means also connected to a second fluid passageway extending from a source of fluid pressure through said blocking valve means and joins said remaining fluid channel extending through said telescoping cylinders.

10. An apparatus according to claim 9, wherein said pressure distribution valve means comprises a hydraulically actuated, three-way pressure control valve assembly having first and second control inlets, said first control inlet joining said first fluid passageway and said second control inlet joining said second fluid passageway for the selective passage of a fluid medium through said valve assembly.

11. An apparatus according to claim 5, wherein said remaining channel includes an end portion in contact with a side of said fixed piston member furthest from said point of attachment between said cylinder members and said weapon frame;

a first block valve positioned in a portion of said passage means leading to said one channel and a second blocking valve positioned in a portion of said passage means leading to said remaining channel.

12. An apparatus according to claim 11, wherein a shock valve extends through said fixed piston member, said shock valve being in fluid communication with said remaining channel to selectively introduce a fluid medium against said fixed piston of said movable piston members.

13. An apparatus according to claim 12, wherein compensation piston means are mounted within said telescoping cylinders for transferring the unbalanced weight of said barrel against said furthest side of said fixed piston member, said pressure distribution valve means acting to transfer fluid pressure to said closest side of said movable piston, wherein said unbalanced weight of said barrel is opposed by said fluid pressure to control the position of said barrel.

14. An apparatus according to claim 1, wherein operating means is attached to said pressure distribution valve means for controlling both the elevation and transverse position of said barrel.

15. An apparatus according to claim 8, wherein said blocking valve means and said pressure distribution means are formed as an integral unit attached to one of said cylinder members.

16. An apparatus according to claim 10, wherein said pressure distribution valve assembly includes two valve slides having different areas, said first slide selectively coacting with a first control edge of said valve assembly to achieve a constant pressure through said valve and retain said barrel in a stationary position, said second slide selectively coacting with a second edge of said valve assembly and with a constriction formed in said passage means to change the flow of fluid through said valve assembly to elevate said barrel;

wherein said constriction causes said pressure against said movable piston to increase dependent on the velocity with which said barrel is elevated.

17. An apparatus according to claim 16, wherein a connection channel extends from said constriction through said second slide valve into fluid communication with said first slide valve to increase the closing force of said first slide valve against said second control edge after elevating said barrel.

18. An apparatus according to claim 16, wherein said first and second slide valves include overlapping sections which oppose undesirable flow of fluid when said valve slides are in their closed positions.

* * * * *